United States Patent [19]

Ekström et al.

[11] 4,010,819

[45] Mar. 8, 1977

[54] ARRANGEMENT FOR MUFFLING THE EXHAUST OF A PNEUMATIC ROCK DRILLING MACHINE

[75] Inventors: Gösta Ivar Ekström, Nacka; Karl-Evert Johansson, Ektorp, both of Sweden

[73] Assignee: Atlas Copco Aktiebolag, Nacka, Sweden

[22] Filed: Dec. 2, 1974

[21] Appl. No.: 528,908

[30] Foreign Application Priority Data

Dec. 27, 1973 Sweden ..... 73174393

[52] U.S. Cl. ..... 181/36 A; 173/168; 173/DIG. 2

[51] Int. Cl.[2] ..... F01N 3/06

[58] Field of Search ..... 181/36 R, 36 A; 173/153, 161, 168, 169, DIG. 2

[56] References Cited

UNITED STATES PATENTS

| | | | |
|---|---|---|---|
| 2,152,205 | 3/1939 | Morrison | 181/36 A |
| 3,191,692 | 6/1965 | Ekwall | 173/161 |
| 3,203,489 | 8/1965 | Fuehrer | 173/161 |
| 3,224,527 | 12/1965 | Waldron | 181/36 A |
| 3,554,316 | 1/1971 | Judd et al. | 181/36 A |
| 3,815,705 | 6/1974 | Bennett | 181/36 A |

*Primary Examiner*—Stephen J. Tomsky
*Attorney, Agent, or Firm*—Flynn & Frishauf

[57] ABSTRACT

An elastomer muffler for the exhaust of a pneumatic percussive tool, which comprises an outer and an inner side wall. The cross-sections of the side walls are C-shaped and the side walls are longitudinally unified for forming a cavity therebetween. The muffler is detachably mounted to the tool by resilient snap action. To advantage, the muffler may be used in connection with a pusher leg arrangement for a rock drill. The muffler, then, is mounted on the pusher leg and the inlet mouth thereof is arranged substantially concentrically with the axis of the hinge connection between the pusher leg and the rock drill but spaced axially from said hinge connection. The exhaust port of the rock drill is also substantially concentrically with the hinge connection but spaced axially therefrom.

18 Claims, 7 Drawing Figures

25
24
26
22
20
19
21
23
18
10
11
IV
IV
75
68
74
67
73
72
66
14
13
56
80
69
15
71
70
12
II
65
II
57
61
59
60
58
62
63
64
16
17

59
57
12

10
11
72
75
74
73

Fig. 4
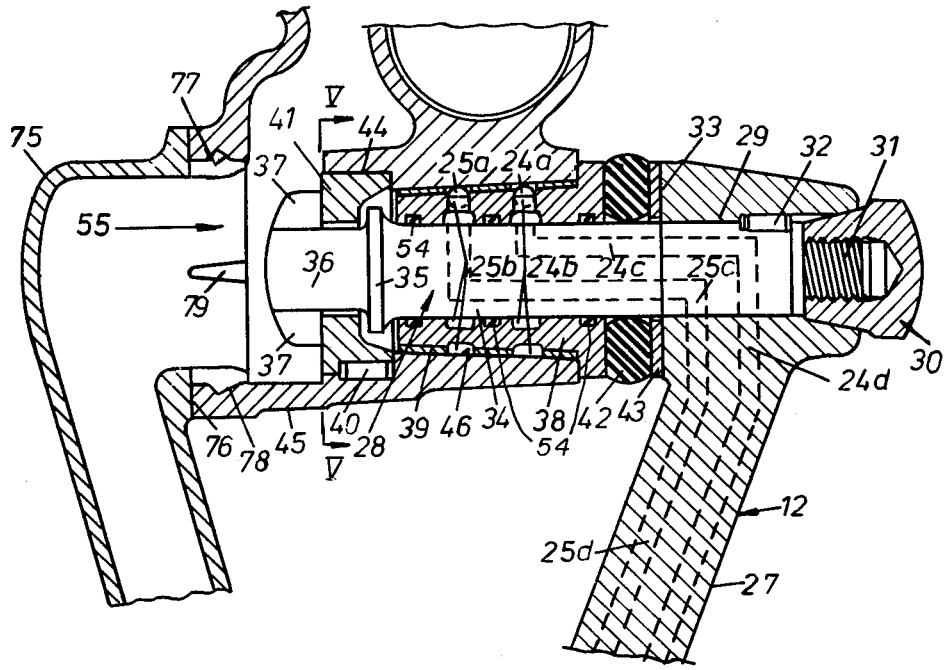
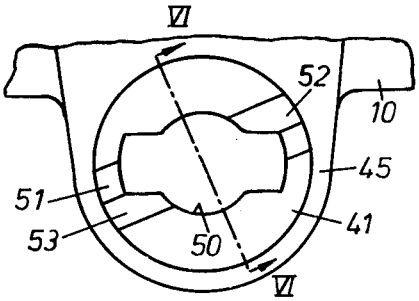
Fig. 5
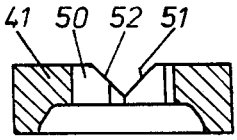
Fig. 6
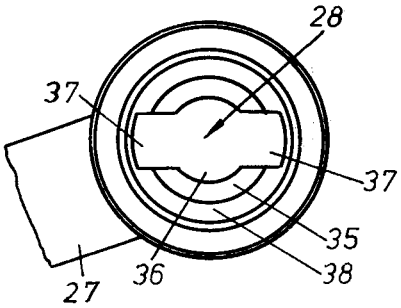
Fig. 7

ARRANGEMENT FOR MUFFLING THE EXHAUST OF A PNEUMATIC ROCK DRILLING MACHINE

This invention relates to a muffler for the exhaust of pneumatic percussive tools. The invention is especially suited for application to rock drills which are supported and fed by an extensible pressure fluid operated pusher leg.

In rock drills of the above-mentioned type different solutions have been presented intended to muffle the noise which is caused by the exhaust air. In one previously known construction a muffler casing has been mounted on the outside of the pusher leg concentrically therewith. The exhaust air from the rock drill is conducted into the muffler casing via channels in the hinge connection between the rock drill and the pusher leg. The restricted dimensions of these channels and the quantity of expanded air cause shutdowns of the rock drill because of freezing in the channels and icing of the casing. In other previously known constructions noise muffling expansion chambers have been mounted directly on the rock drill. In such solutions, however, the rock drill takes up a great deal of room. These embodiments become very disadvantageous especially at underground work besides which there is a great risk of mechanical damages to the muffler. It has also been suggested to mount on the one hand a first muffler directly on the rock drill and on the other a second muffler on the pusher leg, whereat the expansion of the air comes to pass successively through the two mufflers. The mufflers are mutually connected by a resilient hose. In such a construction the risk of damages to the hose is great besides which the resilient hose may be hindering at the drilling. This invention intends to eliminate the above-mentioned disadvantages. That has been obtained by giving the invention the characterizing features stated in the claims following hereinafter.

BRIEF DESCRIPTION OF THE DRAWINGS

FIG. 4 is an enlarged section taken on the line IV—IV in FIG. 1;

FIG. 5 is a side view of a portion of the drilling machine taken on the line V—V in FIG. 4;

FIG. 6 is a section taken on the line VI—VI in FIG. 5; and

FIG. 7 is a fragmentary side view of the upper extremity of the pusher leg intended for cooperation with the portion of the rock drilling machine shown in FIG. 5.

DETAILED DESCRIPTION

Figures 1, 2, 3:
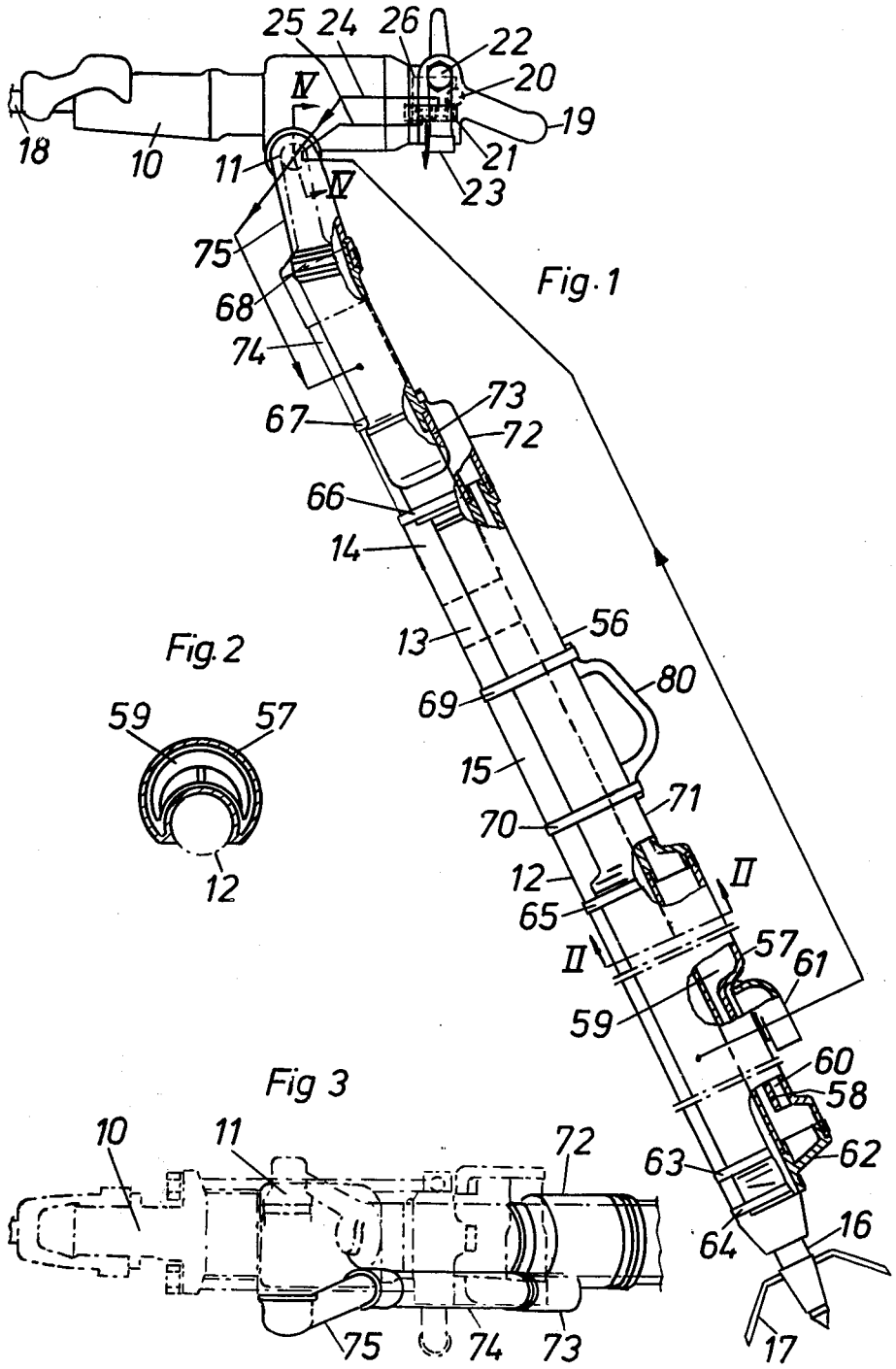
FIG. 1 shows a diagrammatic side view of a pusher leg arrangement for a rock drilling machine in which the invention is applied.
FIG. 2 shows a section taken on the line II—II in FIG. 1.
FIG. 3 is a fragmentary top view of the rock drilling machine in FIG. 1.

The pusher leg arrangement for rock drills illustrated in the drawings comprises of a pressure fluid operated hammer drill 10, which by means of a transverse hinge connection 11 is tiltably mounted on the upper extremity of a conventional pressure fluid operated pusher leg 12. The pusher leg 12 may be of any suitable type and for example having a cylinder housing in which a piston 13 defines upper and lower working chamers 14, 15, respectively. The piston 13 is provided with a piston rod 16 protruding out of the cylinder housing and carrying at its free end a foot piece 17 intended to rest on the ground.

The drilling tool 10 is provided at its rear with a grasping handle 19 for the directing and guiding of the tool during work and carries a drill steel 18. The hammer drill is preferably also equipped with control means for controlling the flow of pressure fluid to and from the pusher leg 12. To this end there may be provided on the hammer drill 10, a reduction valve 20 operable by a handle, not shown, and a slide valve 21. The slide valve 21 may for example be arranged for convenient manipulation from the grasping handle 19 by means of a trigger, not shown, mounted thereon. The hammer drill 10 has a conventional throttle valve 22, to which valve pressure fluid is conducted by means of a fluid supply line 23. According to FIG. 1 in the diagrammatically illustrated position of the slide valve 21 there is established a communication 24 from the throttle valve 22 via the reduction valve 20, the slide valve 21 and the hinge connection 11 to the upper working chamber 14. By manipulation of the handle of the reduction valve 20 the working chamber 14 may be supplied with fluid at a pressure reduced at will in order to provide for efficient feeding of the drilling tool forwardly by extension of the pusher leg 12. Simultaneously therewith a communication 25 via the hinge connection 11 and the slide valve 21 connects the lower working chamber 15 to atmosphere. In order to contract the pusher leg the pressure fluid supply to the pusher leg preferably may be reversibly arranged by means of the slide valve 21, which in another position, not shown, vents the upper working chamber 14 via the communication 24 and connects a direct passage 26 from the throttle valve to the communication 25, i.e. to the lower working chamber 15 of the pusher leg for contracting the leg.

In connection with the general arrangement of the drilling tool and the pusher leg described above there is provided according to the invention a releasable hinge connection 11 between the two components in question. As shown in FIG. 4, the upper extremity of the pusher leg 12 carries an arm 27 extending at one side thereof upwardly from the cylinder housing at an acute angle. A transverse pivot or trunnion 28 providing bearing element or trunnion is firmly connected at one end to the arm 27 by means of a tapered connection 29 firmly secured axially by means of a tapered lock nut 30 bearing against the arm 27 and in threaded engagement with an end portion 31 of the trunnion 28. The tapered connection 29 may be secured against rotation by means of an axial pin 32. Adjacent to the tapered connection 29 an annular shoulder or abutment 33 is provided on the arm 27. The trunnion 28 has a cylindrical intermediate portion 34 extending between the abutment 33 and a flange 35 on the trunnion. Outwardly of the flange the trunnion 28 is formed with a co-axial reduced cylindrical portion 36 carrying at its free end radial opposed abutments 37 and providing one member of a bayonet-lock.

slidably and turnably arranged on the cylindrical intermediate portion 34 of the trunnion 28 is a tapered bushing 38 providing bearing element, having its tapered portion covered by a rubber lining 39 suitably applied thereto, for example by vulcanizing. Between the bushing and the abutment 32 there is placed an elastically compressible rubber ring 42 around the trunnion 28. A washer 43 is provided on the trunnion 28 in line with the rubber ring 42 for frictional contact with the abutment 33. The tapered bushing 38 is prevented from sliding off axially from the cylindrical portion 34 by the flange 35 when the rubber ring 42 is in its expanded state. The hammer drill 10 is provided at an intermediate portion thereof with a transverse boss 45 and a tapered transversely extending hole 46 therein. The hole 46 is intended for cooperation with the correspondingly tapered rubber lining 39 of the bushing 38. As a co-axial continuation of the hole 46 there is provided a bore 44 at one end of the boss 45. Another member 41 of a bayonet-lock is firmly fitted into the bore 44 and is retained against rotation with respect to the bore by means of a locking pin 40. The locking member 41 is provided with an axial key opening 50 intended for insertion of the member of the bayonet-lock of the trunnion 28, i.e. the reduced cylindrical portion 36 together with its opposed abutments 37 in a certain angular position of said abutments. The angular interarrangement of the abutments 37 and the key opening 50 is such, that the hammer drill 10 has to be tilted to an extreme downward-forward position with respect to the pusher leg 12 in order to bring the key opening into alignment with the abutments 37. The locking member 41 is formed with a diametrically extending V-shaped recess 51 forming diametrically opposed axial cam surfaces 52, 53. The depth of the V-shaped recess is preferably such that the abutments 37, when inserted into the key opening 50, will be about level with the cam surfaces 52, 53 when axial contact is established between the bushing 38 and the corresponding tapered hole 46 in the boss 45.

Supposing the pusher leg and the hammer drill to be in separated state, the hammer drill 10 with the drill steel 18 removed is grasped by the handle 19 and kept in an inclined upstanding position on the ground. Thereupon the trunnion 28 of the pusher leg is pushed into the tapered hole 46 until the bushing 38 contacts the hole 46 with the rubber lining 39. By means of a quick upward-backward pull of the handle 19 the hammer drill 10 thereupon is lifted from the ground tilting with respect to the pusher leg 12 from the extreme forward tilt position into some intermediate tilt position, for example the position of FIG. 1. Such tilting of the hammer drill 10 causes the cam surfaces 52, 53 to penetrate under the abutments 39 which slide upward along said cam surfaces causing an axial displacement of the locking member 41 together with the boss 45 and the bushing 38 in the direction of the abutment 33 until the abutments 39 ride up on the end surface of the locking member 41. The axial movement of the bushing 38 causes a compression of the elastic rubber ring 42, which urges the aligned friction washer 43 into frictional contact with the abutment 33, whereat the urging force is proportional to the compression of the ring 42. In the final assembled position of the parts involved the friction washer 43 receives a predetermined invariable compression dependent upon the added width of the locking member 41, the boss 45 and the bushing 38 as compared to the distance between the washer 43 and the abutments 37. The rubber lining 39 and ring 42 prevent in their compressed state relative movement and wear between the washer 43, the bushing 38, and the boss 45. Tilting of the hammer drill on the trunnion 28 druing work of the pusher leg arrangement thus results in free relative turning motion of the bushing 38 with respect to the trunnion 28 and relative motion against a predetermined invariable resistance between the washer 43 and the annular abutment 33.

For quick separation the hammer drill 10 is again tilted to the extreme forward-downward position, in which position the abutments 37 will be aligned with the key opening 50 so that free separation in the axial direction along the rubber lining 39 and the hole 46 may be performed. Obviously such forward-downward position is never applied during normal use of the pusher leg arrangement.

For purposes of convenient conducting of pressure fluid to and from the pusher leg through the above indicated communication 24, 25, longitudinal pssages **24*a*, 25*a*, FIG. 4, are provided in the hammer drill 10 between the tapered hole 46 and the slide valve 21. Said passages are followed by peripheral grooves and radial perforations 24*b*, 25*b* in the bushing 38, longitudinal passages 24*c*, 25*c* through the trunnion 28, and passages 24*d*, 25*d* in the pusher leg 12 leading to the respective working chambers 15, 14. The rubber lining 39 serves as a seal for the grooves 24*b*, 25*b* at the tapered surface of the bushing 38 while O-rings 54 tightening against the intermediate portion 34 of the trunnion 28 are provided inside of the bushing 38.**

As may be seen in FIG. 1 a muffler housing 56 is mounted outside the pusher leg 12 extending therealong. In the embodiment shown as an example the muffler housing 56 is formed of resilient material, preferably plastic, and is fitted on the pusher leg 12 by resilient snap action, FIG. 2. The muffler housing 56 is along the major part of the pusher leg 12 mounted on the upper side thereof. Such a mounting is especially advantageous when drilling adjacent to the floor. By the fact that the muffler housing 56 encloses the pusher leg 12 about somewhat more than half the circumference on the one hand the muffler is firmly secured with respect to said pusher leg and on the other there is obtained a large muffling volume. The muffler housing 56 is made up of several members detachably attached to each other. The member 57 of the muffler housing nearest to the foot piece 17 is provided with a partition wall 58 which separates a lower expansion chamber 59 from an upper expansion chamber 60. An exhaust elbow pipe 61 for the completely expanded air is stuck into the upper expansion chamber 60. The elbow pipe 61 is swingable by which the exhaust air may be directed in an optional direction. The member 57 of the muffler is closed at its lower end by a bottom piece 62. An intermediate member 71 of the muffler housing is stuck into the member 57. The upper portion of the intermediate member 71 is stuck into an upper member 72 of the housing. Integrally with the upper member 72 and at one side of the pusher leg 12 there is a socket 73 for a pipe 74 extending along said side of the pusher leg 12. An elbow pipe 75 is connected to the pipe 74. The pipe 74 and the elbow pipe 75 form a neck on the muffler housing, said neck comprising an inlet mouth at the end nearest to the hammer drill. The inlet is perpendicular to the longitudinal direction of the pusher leg 12 and is tightly connected to the exhaust port 55 of the hammer drill. The neck 74, 75 is resiliently yieldable to make possible insertion of the inlet into the exhaust port when the muffler housing 56 is mounted on the pusher leg 12. The elbow pipe 75 is provided with an annular abutment 76 at the inlet mouth thereof. At mounting, the inlet mouth portion of elbow pipe 75 is pushed into the exhaust port 55 of the hammer drill unitl the annular abutment 76 contacts a corresponding surface on the transverse boss 45. The elbow pipe 75 is held on place by means of an annular bulge 77 arranged thereon, said bulge mating an annular groove 78 running around the exhaust port. At pushing the elbow pipe 75 into the exhaust port the bulge 77 will snap into the groove 78. In order to facilitate assembling and disassembling the portion of the elbow pipe projecting into the exhaust port is provided with slots 79. The separate members 57, 62, 71, 72 of the muffler are mutually fixed and are secured against rotation around the pusher leg 12 by means of straps 63, 64, 65, 66 and 67. The pipe 74 and the elbow pipe 75 are fixed mutually by means of a strap 68. A handle 80 is attached to the intermediate member 71 by means of straps 69, 70.

By arranging the exhaust port of the hammer drill substantially concentrically with but separated axially from the hinge connection 11 it is possible to connect the muffler 56 extending along the pusher leg 12 directly to the exhaust port without using an intermediate hose. When tilted about the hinge connection 11 the hammer drill 10 will turn around the inlet of the elbow pipe. The construction, thereby becomes robust without having a negative effect upon the demand for an easy handling of the hammer drill. The risk of freezing of the water vapor normally present in the operating air at the expansion of the exhausting air is also eliminated by the fact that the passages for the exhausting air can be made with large dimensions.

The connection between the elbow pipe 75 and the hammer drill can be made in different manners. Instead of securing said pipe and hammer drill to each other by resilient snap action as in the embodiment shown as an example the connection can to advantage be made as a bayonet-lock since this type of coupling is used in the hinge connection between the hammer drill and the pusher leg. The above described muffler construction may, of course, also be used in connection with any type of pneumative percussive tools.

The invention is not limited to the embodiment shown and described by way of example but can be modified within the scope of the claims following hereinafter.

What we claim is:

1. In a pusher leg arrangement for rock drills, the combination of a pneumatic rock drill (10) and a pressure fluid operated pusher leg (12) for the supporting and feeding of said rock drill, means (11) for providing a hinge connection between said pusher leg and said rock drill, a muffler housing (56) associated with said pusher leg, an exhaust port (55) in said rock drill through which air under pressure is discharged during operation of said rock drill, and means for fluid tight connecting said muffler housing to said exhaust port, said fluid tight connecting means including an inlet mouth, said inlet mouth being arranged substantially in alignment with said hinge connection but spaced axially therefrom.

2. In a pusher leg arrangement for rock drills, the combination of a pneumatic rock drill (10) having an exhaust port (55) through which air under pressure is discharged during operation of said rock drill and a pressure fluid operated pusher leg (12) for the supporting and feeding of said rock drill, a hinge connection (11) between said rock drill and said pusher leg located at the upper extremity of said pusher leg, a muffler housing (56) mounted on said pusher leg, said muffler housing having a neck portion (74, 75), said neck portion including an inlet mouth portion, said inlet mouth portion being substantially perpendicular to a pivotal plane of said rock drill, and means for fluid tight connecting said inlet mouth portion to the exhaust port (55) of said rock drill, said fluid tight connecting means being arranged substantially concentric with the axis of said hinge connection but spaced axially therefrom.

3. An arrangement according to claim 2, wherein said muffler housing is of elastomeric material, and said muffler housing includes a surface on said housing complementary to the outer surface of said pusher leg, said complementary surface enclosing said pusher leg over more than half the circumference thereof whereby to provide a securing of said housing on said pusher leg by resilient snap action.

4. In a pusher leg arrangement for a pneumatic percussive tool, the combination of a pneumatic percussive tool and a pressure fluid operated pusher leg (12) for the supporting and feeding of said percussive tool, a muffler comprising an elongate body (56) of elastomeric material, said body having an outer side wall, an inner side wall and a neck portion (74, 75), the cross-sections of said side walls being substantially C-shaped, said side walls being unified along the opposed longitudinal extents thereof so as to define a cavity (59) therebetween, said inner side wall of said body (56) being of a complementary shape to an outer surface of said pusher leg and enclosing said outer surface of said pusher leg over more than half the circumference thereof to provide for detachably mounting of said body to said pusher leg, said unified portions of said side walls providing a resilient snap action type of connection between said pusher leg and said body (56), an exhaust port (55) in said percussive tool through which air under pressure is discharged during operation of said percussive tool, and fluid tight connection means (77) on said neck portion of said body for securing said neck portion in said exhaust port in order to provide a fluid tight connection therebetween.

5. An arrangement according to claim 4, comprising a hinge connection between said percussive tool and said pusher leg, said hinge connection being located at the upper extremity of said pusher leg and extending transversely with respect thereto and to said percussive tool, said neck portion including an inlet mouth (55) portion, said inlet mouth portion being substantially perpendicular to a pivotal plane of said percussive tool and substantially concentric with the hinge connection axis but spaced axially therefrom.

6. An arrangement according to claim 5, comprising a projection (77) on said inlet mouth portion, and a groove (78) in said exhaust port and mating with said projection to provide a securing between said neck portion and said percussive tool by resilient snap action.

7. An arrangement according to claim 6, comprising abutting surfaces (76) on said neck portion and on said percussive tool, said abutting surfaces contacting each other when said projection (77) is in said groove (78).

8. An arrangement according to claim 4, comprising a socket (73) in said body (56) in the upper end thereof, said socket being located at a side of said pusher leg for receiving one end of said neck portion in said socket.

9. An arrangement according to claim 4, wherein said neck portion is made of resiliently yieldable material.

10. An arrangement according to claim 5, comprising a coupling of the bayonet-lock type between said neck portion and said percussive tool, said coupling releasing said neck portion in a defined angular position between said percussive tool and said pusher leg.

11. An arrangement according to claim 4, comprising an outlet pipe (61) on said body (56), said outlet pipe being turnable relative to said body for directing the exhaust from the muffler in an optional direction.

12. An arrangement according to claim 4, wherein said body (56) is mounted on the upper side of said pusher leg to permit drilling close to the floor, and comprising a handle (80) attached to said body.

13. An improved rock drill (10) of the type which is supported and fed by a pressure fluid operated pusher leg (12), having a pusher leg attached muffler, and which is tiltable about a hinge connection (11) between said rock drilling machine and said pusher leg, said hinge connection (11) being located at the upper extremity of said pusher leg, wherein the improvement comprises an exhaust port (55) in said rock drill, said exhaust port being substantially concentric with the axis of said hinge connection (11) but spaced axially from said hinge connection, menas (78) for pivotally and fluid tight connecting said exhaust port to said muffler such that said rock drill is tiltable about the axis of said hinge, and means for discharging air under pressure through said exhaust port when said rock drill is in operation.

14. An arrangement according to claim 4, wherein said neck portion (74, 75) is located at an end of said body (56).

15. An arrangement according to claim 1, wherein said fluid tight connecting means pivotally connects said muffler housing to said exhaust port to permit tilting of said rock drill about the axis of said hinge.

16. An arrangement according to claim 2, wherein said fluid tight connecting means pivotally connects said inlet mouth portion to said exhaust port to permit tilting of said rock drill about the axis of said hinge.

17. An arrangement according to claim 4, wherein said fluid tight connection means pivotally connects said neck portion to said exhaust port to permit tilting of said percussive tool relative to said pusher leg.

18. An arrangement according to claim 5, wherein said fluid tight connection means pivotally connects said neck portion in said exhaust port to permit tilting of said percussive tool about the axis of said hinge.

* * * * *